US011728553B1

(12) United States Patent
Wrigley

(10) Patent No.: US 11,728,553 B1
(45) Date of Patent: Aug. 15, 2023

(54) DUAL-BAND WAVEGUIDE FEED NETWORK

(71) Applicant: LOCKHEED MARTIN CORPORATION, Bethesda, MD (US)

(72) Inventor: Jason Stewart Wrigley, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 12 days.

(21) Appl. No.: 17/505,448

(22) Filed: Oct. 19, 2021

Related U.S. Application Data

(60) Provisional application No. 63/093,733, filed on Oct. 19, 2020.

(51) Int. Cl.

| | |
|---|---|
| ***H01P 1/213*** | (2006.01) |
| ***H01P 3/12*** | (2006.01) |
| ***H01P 1/207*** | (2006.01) |
| ***H01P 1/165*** | (2006.01) |
| ***H01P 1/161*** | (2006.01) |

(52) U.S. Cl.
CPC ..... *H01P 1/2131* (2013.01); *H01P 1/161* (2013.01); *H01P 1/165* (2013.01); *H01P 1/207* (2013.01); *H01P 3/12* (2013.01)

(58) Field of Classification Search
CPC ..... H01P 1/2131; H01P 1/213; H01P 1/161; H01P 1/165
USPC ..... 333/21 A, 135
See application file for complete search history.

(56) References Cited

U.S. PATENT DOCUMENTS 9,947,978 B1 * 4/2018 Tavassoli Hozouri ..... H01P 1/165
2010/0149058 A1 * 6/2010 Bosshard et al. ..... H01P 1/161 343/756

* cited by examiner

*Primary Examiner* — Benny T Lee
(74) *Attorney, Agent, or Firm* — BakerHostetler

(57) ABSTRACT

A feed network is provided that includes a transmit section, a body section coupled to the transmit section, and a receive section coupled to the body section. The transmit section and the body section form a transmitter unit coupled to a first section of a core waveguide, wherein the first section of the core waveguide is a square waveguide. The body section and the receive section form a receiver unit coupled to a second section of the core waveguide, wherein the second section of the core waveguide is a circular waveguide.

19 Claims, 9 Drawing Sheets

| | Freq (GHz) | Axial Ratio (dB) | Return Loss (dB) | Port to Port (dB) | PIM Products Falling in Rx | Higher Order Mode Suppression (dB) |
|---|---|---|---|---|---|---|
| ❖ Tx Band Broad | 17.7 to 20.2 | < 0.50 | > 27 | > 27 | $7^{th}$ | > 42 |
| ❖ Tx Band Narrow | 17.8 to 19.3 | < 0.25* | > 32 | > 32 | $10^{th}$ | > 42 |
| ❖ Rx Band | 27.5 to 30.0 | < 0.35 | > 28 | > 28 | - | > 42 |

*FIG. 9*

DUAL-BAND WAVEGUIDE FEED NETWORK

This application claims the benefit of Provisional Application No. 63/093,733 filed on Oct. 19, 2020, which is hereby incorporated by reference.

STATEMENT REGARDING FEDERALLY SPONSORED RESEARCH OR DEVELOPMENT

Not applicable.

TECHNICAL FIELD

The present description relates generally to satellite communications including, for example, waveguide feed networks.

BACKGROUND

Waveguide feed networks that cover wide bandwidths may be composed of many parts and may have a high level of complexity. Higher part count can lead to higher mass for the feed network, which is undesirable for satellite applications. In addition, increased complexity can lead to increased manufacturing risks and costs.

BRIEF DESCRIPTION OF THE DRAWINGS

Certain features of the subject technology are set forth in the appended claims. However, for purpose of explanation, several embodiments of the subject technology are set forth in the following figures.

FIG. 9 is a chart presenting performance numbers for different bands according to aspects of the subject technology.

DETAIL DESCRIPTION OF THE INVENTION

Figure 1:
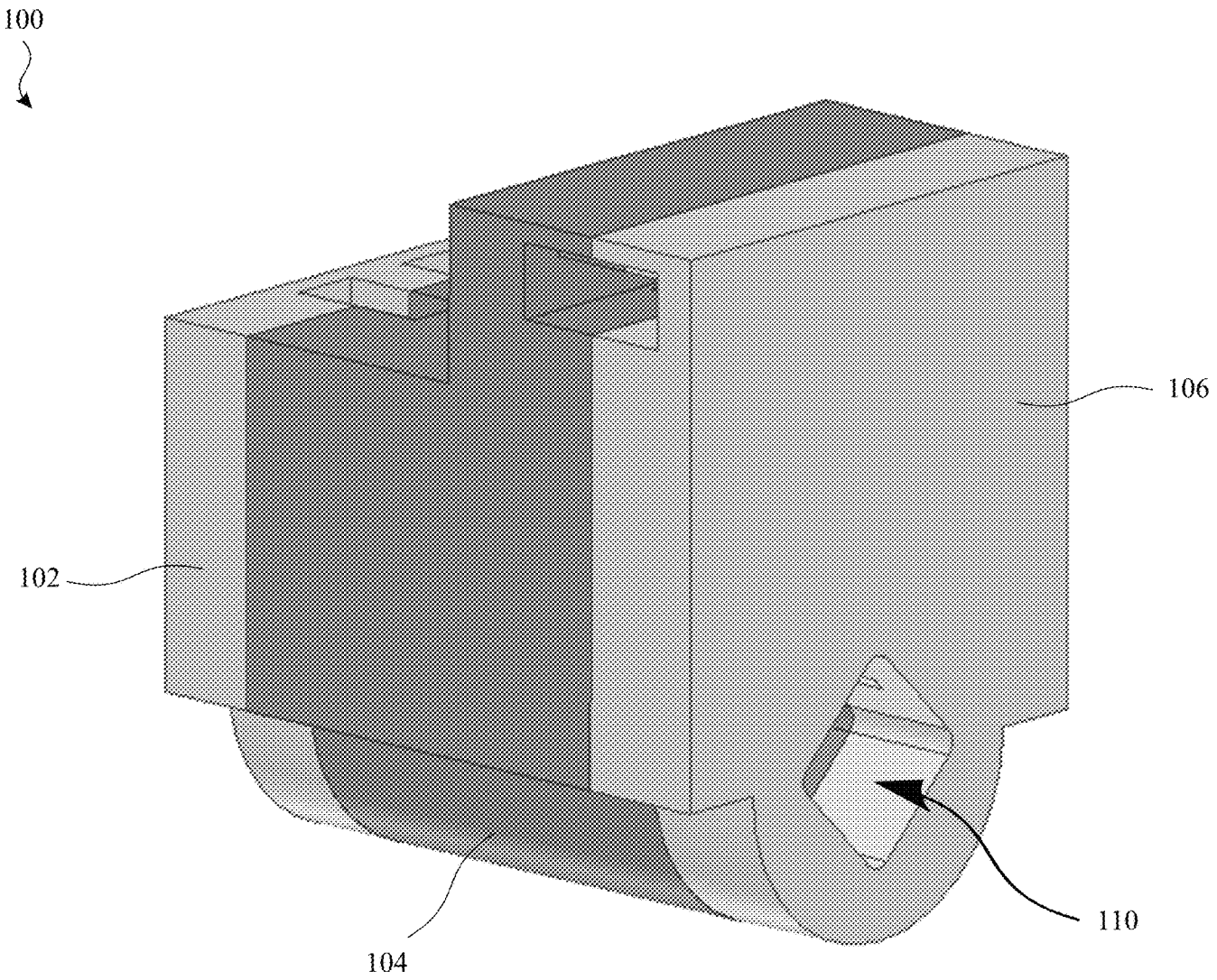
FIG. 1 is a diagram illustrating a perspective view of a feed network according to aspects of the subject technology.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, the subject technology is not limited to the specific details set forth herein and can be practiced using one or more other implementations. In one or more implementations, structures and components are shown in block diagram form in order to avoid obscuring the concepts of the subject technology.

The present disclosure is directed, in part, to a feed network with dual circular polarization for satellite communications. A satellite may include a satellite receiver coupled to a satellite antenna system for receiving uplink signals, and may also include a satellite transmitter coupled to the satellite antenna system for transmitting downlink signals. The feed network may be coupled between elements of the satellite antenna system and the satellite receiver and also may be coupled between the elements of the satellite antenna system and the satellite transmitter. The feed network that couples the satellite transmitter to the satellite antenna system may transform a linearly polarized signal received from the satellite transmitter into one of a right hand or a left hand circularly polarized signals for the satellite antenna system to be transmitted. Also, the feed network that couples the satellite receiver to the satellite antenna system may transform a received right hand or left hand circularly polarized signal from the satellite antenna system into a linearly polarized signal for the receiver. By providing circularly polarized signals for communication to and from the satellite, the communications may not be sensitive to an orientation of transceiver devices that communicates with the satellite.

The feed network includes a receiver unit and a transmitter unit. The transmitter unit may include two branches and two input ports, a first input port on a first end of a first branch and a second input port on a first end of a second branch. The input ports may also be coupled to circuitry for receiving input signals that can be linearly polarized signals. The transmitter unit can be coupled to a section of a core waveguide that is a square waveguide via the second end of the two branches that can include evanescent waveguides and may provide a circularly polarized signal based on the received signals at the input ports. The transmitter unit may provide a left hand circularly polarized signal at the core waveguide when the input signal is received from the first input port and may provide a right hand circularly polarized signal at the core waveguide when the input signal is received from the second input port. The transmitter unit may include an integrated branch line coupler between the two branches for generating the left hand and right hand circularly polarized signals. The integrated branch line coupler may have one or more branches between the first and second branches to form a branch line coupler. The integrated branch line coupler may include waveguide filters performing as waveguide reject filters that are integrated into the first and second branches. The waveguide reject filters may be used for isolating the input ports from undesired signals in the core waveguide. The waveguide reject filters of the integrated branch line coupler may include single-sided stubs that may be used for further tuning the waveguide reject filters.

The receiver unit may include two branches and two output ports, a first output port at a first end of a first branch and a second output port at a first end of a second branch. The receiver unit can be coupled to a section of the core waveguide that is a circular waveguide via the second end of the two branches to receive a left hand or right hand circularly polarized signal. The receiver unit may receive a left hand circularly polarized signal from the core waveguide and may provide a linearly polarized signal at a first output port. Alternatively, the receiver unit may receive a right hand circularly polarized signal from the core waveguide and may provide a linearly polarized signal at a second output port. The receiver unit may include an integrated branch line coupler coupled between the two branches for creating linearly polarized signals from the left hand and right hand circularly polarized signals. Waveguide reject filters may be integrated into each one of the branches of the integrated branch line coupler for isolating the output ports from undesired signals in the core waveguide.

Using a square waveguide for the section of the core waveguide coupled to the transmitter unit provides advantages over using a circular waveguide for the entire core waveguide. For example, the square waveguide allows the degenerate TE11 and TM11 modes, which decay, to be used to the advantage of the design in place of the two instances of the TE21 mode that exist in a circular waveguide. The dimensions of the square waveguide can be selected to place the TE11 and TM11 modes cutoffs in between a receive band and a transmission band and at a position that provides ample frequency room to decay before the lowest receive frequency. In addition, the TE20 mode cutoff in the square waveguide can be selected high enough above the receive band to allow a broad receive band to be used. Accordingly, bands such as the commercial Ka band, which requires 52% bandwidth, may be used with the subject technology. The subject technology is not limited to the commercial Ka band and may be implement for other communication bands including the military Ka band.

Figure 2:
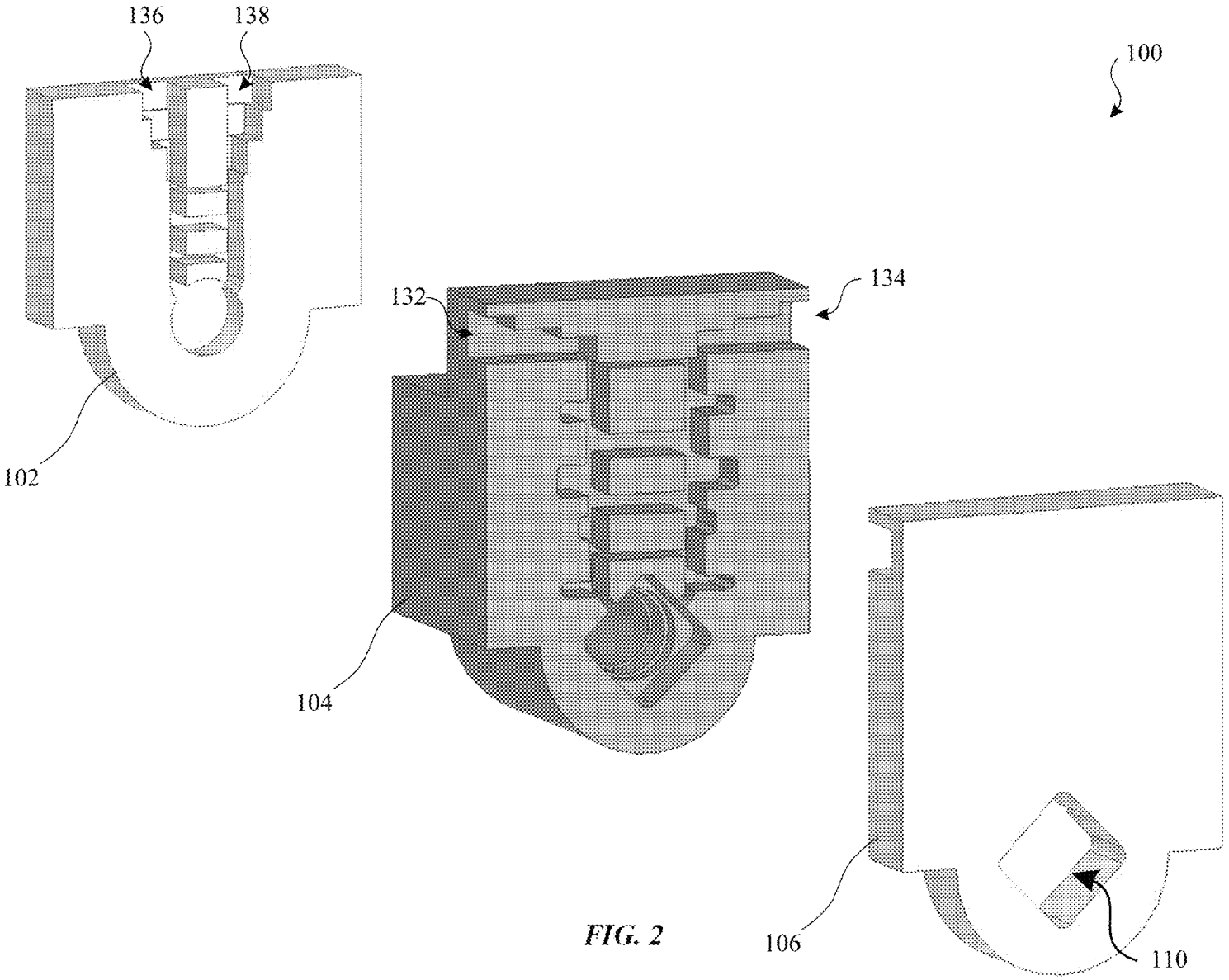
FIG. 2 is a diagram illustrating an exploded view of components of a feed network according to aspects of the subject technology.

FIG. 1 is a diagram illustrating a perspective view of a feed network and FIG. 2 is an exploded view of components of the feed network according to aspects of the subject technology. As illustrated in the FIGS. 1 and 2, feed network 100 include a receive section 102, a body section 104, and a transmit section 106. Receive section 102 may be coupled with body section 104 to form a receiver unit, which is described in detail below. Transmit section 106 may be coupled with body section 104 to form a transmitter unit, which is described in detail below.

Feed network 100 includes core waveguide 110. Core waveguide penetrates transmit section 106 and body section 104, and terminates in receive section 102. A section of core waveguide 110 in transmit section 106 and partially in body section 104 is a square waveguide. This section of core waveguide 110 is coupled to the transmitter unit. In body section 104, core waveguide 110 abruptly is adapted to a circular waveguide, which continues into receive section 102. The section of core waveguide 110 is coupled to the receive unit.

According to aspects of the subject technology, the transmitter unit comprises two segments. A first segment of the transmitter unit is included in body section 104 and a second segment of the transmitter unit is included in transmit section 106. Thus, the transmitter unit is formed when transmit section 106 and body section 104 are connected to each other. In some examples, connecting transmit section 106 and body section 104 also forms two input ports 132 and 134 as shown in FIG. 1. The transmitter unit may receive a signal through one of input ports 132 and 134 that causes the transmitter unit to transmit a circularly polarized wave through core waveguide 110. For example, the transmitter unit may receive a signal through input port 132 and transmit a right hand circularly polarized wave through core waveguide 110. Similarly, transmitter unit may receive the signal through input port 134 and transmit a left hand circularly polarized wave through core waveguide 110. Feed network 100 may provide an isolation of better than 25 dB between input ports 132 and 134 of the transmitter unit.

According to aspects of the subject technology, the receiver unit comprises two segments. A first segment of the receiver unit is included in body section 104 and a second segment of the receiver unit is included in receive section 102. Thus, the receiver unit is formed when receive section 102 and body section 104 are connected to each other. In some examples, connecting receive section 102 and body section 104 also forms two output ports 136 and 138 as shown in FIG. 1. The receiver unit may receive a circularly polarized wave through core waveguide 110 that causes the receiver unit to generate a signal at one output ports 136 or 138. For example, the receiver unit may receive a right hand circularly polarized wave and generate a linearly polarized signal at output port 136. Similarly, the receiver unit may receive a left hand circularly polarized wave and generate a linearly polarized signal at output port 138. Feed network 100 may provide an isolation of better than 25 dB between output ports 136 and 138 of the receive unit.

The components of feed network 100 are not limited to any particular type of material. For example, the components may be manufactured out of aluminum.

Figure 3:
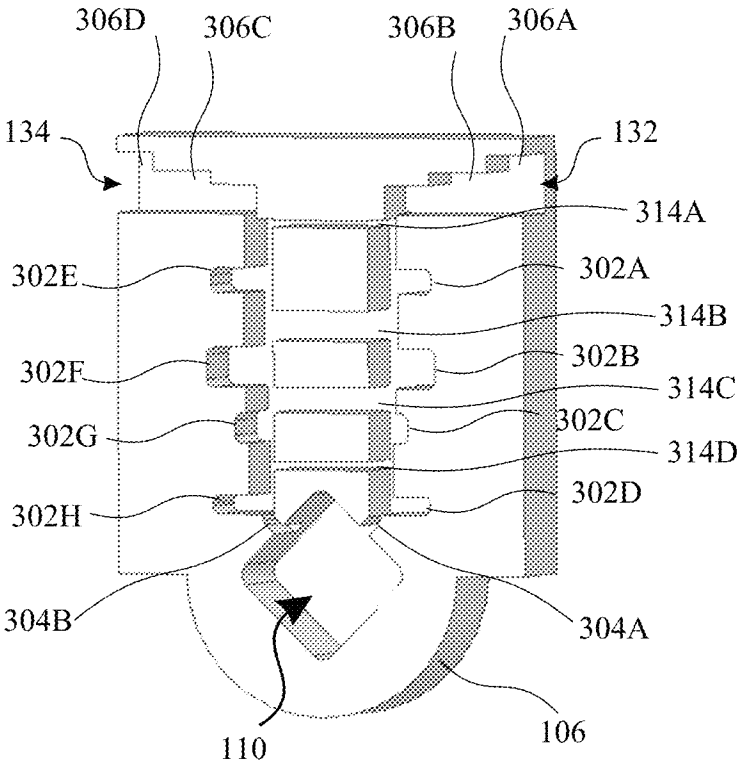
FIG. 3 is a diagram illustrating components of a transmitter unit according to aspects of the subject technology.
Figure 3:
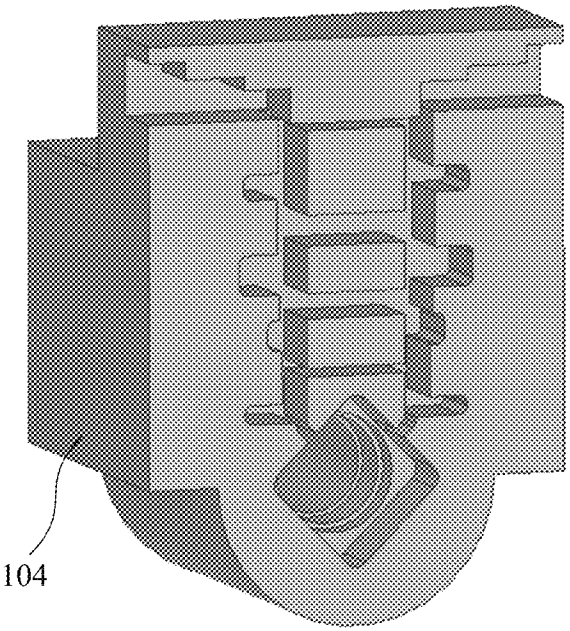

FIG. 3 is a diagram showing perspective views of the body section 104 and the transmit section 106 that house opposing segments of the transmitter unit according to aspects of the subject technology. The complementary segments may be symmetrical with respect to an outer surface of the body section 104 and the transmit section 106 and thus a zero electric field is generated at the outer surfaces, which form a split plane when the transmit section 106 and the body section 104 are joined together. Accordingly, the split plane exists on the zero current regions of the waveguides forming the transmitter unit.

The transmitter unit includes two branches that couple input ports 132 and 134 to core waveguide 110. Each one of the branched includes a waveguide reject filter that includes one or more stubs, e.g., four stubs. As an example, FIG. 3 shows four single-sided stubs 302A, 302B, 302C, and 302D on a first branch and four single-sided stubs 302E, 302F, 302G, and 302H on a second branch. As shown the stubs are protruding outward. The waveguide reject filters may be implemented to prevent signals in certain frequency bands from reaching input ports 132 and 134. In some examples, the waveguide reject filters are low pass filters and the sizes of the filters including the sizes of stubs 302A, 302B, 302C, 302D, 302E, 302F, 302F, and 302G as well as a number of the stubs may be determined based on an allowed wavelength and a rejection band of the waveguide reject filters. In some examples, the waveguide reject filters suppress a signal in a predetermined range that is received via the core waveguide 110 from reaching input ports 132 and 134.

According to aspects of the subject technology, the Ka commercial band may be used for receiving and transmitting signals and allowed frequency ranges and stop (e.g., suppressed) frequency ranges of the transmitter unit are predefined. In some examples, a transmitting frequency band includes frequencies 17.7 GHz to 20.2 GHz that may pass from input ports 132 or 134 to core waveguide 110. The receiving frequency band includes frequencies 27.5 GHz to 30.0 GHz that are suppressed, e.g., by more than 55 dB, from reaching input ports 132 or 134 from the core waveguide 110. Thus, an isolation of better than 55 dB may be achieved for input ports 132 and 132 from undesired signals in the core waveguide that are in the receiving frequency band.

A free end of stubs 302A, 302B, 302C, 302D, 302E, 302F, 302G, and 302H may be short-circuited. Then an input impedance of a short-circuited stub is purely reactive; either capacitive or inductive, depending on the electrical length and width of the stubs and a wavelength of signal passing through the waveguide reject filters. Stubs may thus function as capacitors and inductors in the waveguide reject filters and may be used to tune a bandwidth of the waveguide reject filters. The subject technology is not limited to the use of four stubs and may be implement with fewer or more than four stubs to further shape a frequency response of waveguide reject filters.

The transmitter unit also includes two evanescent waveguides 304A and 304B that are coupled between the two branches and the core waveguide 110. In some examples, a size of evanescent waveguides 304A and 304B are adjusted such that an insertion loss between core waveguide 110 and the waveguide reject filters of the two branches are less than a predetermined level, e.g., less than 0.05 dB, in each branch. Evanescent waveguides 304A and 304B of first and second branches of the transmitter unit may have predetermined angles, e.g., 45 degrees, when coupled to the core waveguide. The 45-degree turns of evanescent waveguides 304A and 304B may cause a supposed continuation of the first and second branches to intersect each other at a center of core waveguide 110 with an angle equal to 90 degrees. Thus, the ends of the first and second branches coupled to the core waveguide 110 may become perpendicular to each other. Additionally, the 45-degree turn may allow the integrated branch line coupler to stay close to core waveguide 110, reducing a size and mass of the transmitter unit to make it compact.

The transmitter unit may further include transformers 306A, 306B, 306C, and 306D on the first and second branches. The transformers have dimensions that are determined based on a frequency range of the transmitted signals that may be input at input ports 132 and 134 and to minimize an insertion loss of the transmitter unit. In some embodiments, the one or more transformers of each branch are quarter wave transformers that are configured to provide a change of wavelength for matching. By using transformers 306A, 306B, 306C, and 306D, to change the wavelength, the branches may match to a transmitter circuit that can be coupled to input ports 132 and 134.

The transmitter unit includes an integrated branch line coupler that includes couplers 314A, 314B, 314C, and 314D that inwardly couple the first and second branches. The integrated branch line coupler also includes the waveguide reject filters that are described above. A number, size, and location of couplers 314A, 314B, 314C, and 314D may be selected to create left hand circular polarization as well as right hand circular polarization signals in core waveguide 110. The circular polarization signals are created based on the linearly polarized signals that are received from input ports 132 and 134 of the first and second branches. In some examples, the waveguide reject filters have an inner face and an outer face. In some examples, couplers 314A, 314B, 314C, and 314D are coupled between the inner faces of the waveguide reject filters. In some implementations, the integrated branch line coupler provides splitting a power by 3 dB and a 90 degrees phase shift to generate a circular polarization mode from a linear polarization mode. In some examples, the width of couplers 314A, 314B, 314C, and 314D can provide the 90 degrees phase shift. The waveguide reject filters of the integrated branch line coupler may isolate an unwanted circular polarization mode from reaching input ports 132 or 134.

The distance between couplers 314A, 314B, 314C, and 314D may depend on the dimensions of core waveguide 110. In some examples, couplers 314A, 314B, 314C, and 314D are e-plane couplers and a height of the couplers may determine an amount of energy that may be transferred between the branches. As an example, the height of coupler 314B determines an amount of energy that may be transferred between the two branches.

As depicted in FIG. 3, stubs 302A, 302B, 302C, 302D, 302E, 302F, 302G, and 302H are coupled to and extended from the outer face of the waveguide reject filters. In some embodiments, the one or more single-sided stubs 302A, 302B, 302C, 302D, 302E, 302F, 302G, and 302H of the waveguide reject filters correspond to one or more cascaded filter sections. As shown in FIG. 3, the single-sided stubs 302A, 302B, 302C, 302D, 302E, 302F, 302G, and 302H are coupled outwardly to the waveguide reject filters and couplers 314A, 314B, 314C, and 314D are coupled inwardly to the waveguide reject filters in between locations of the single-sided stubs.

According to aspects of the subject technology, the integrated branch line coupler generates, at core waveguide 110, one or both of a right hand circularly polarized signal and a left hand circularly polarized signal from a linearly polarized signal. In some implementations, the transmitter unit receives an input signal at a first frequency at input port 132 of the first branch and generates a right hand circularly polarized signal at the first frequency in core waveguide 110. In some implementations, the transmitter unit receives an input signal at a first frequency from input port 134 of the second branch and generates a left hand circularly polarized signal at the first frequency in the core waveguide 110.

Figure 4:
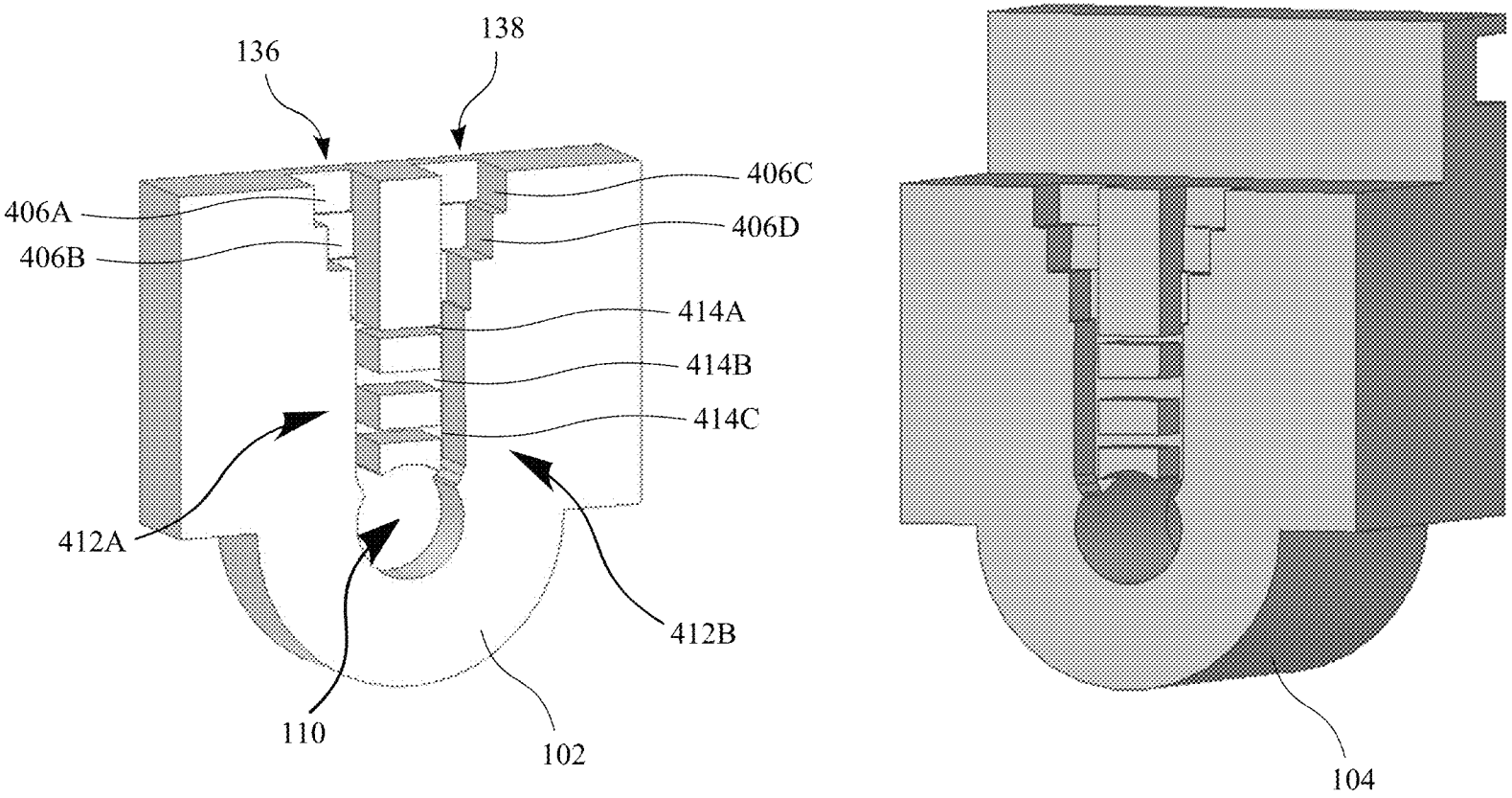
FIG. 4 are diagrams illustrating components of a receiver unit according to aspects of the subject technology.

FIG. 4 is a diagram showing perspective views of the receive section 102 and the body section 104 that house opposing segments of the receiver unit according to aspects of the subject technology. The complementary segments may be symmetrical with respect to an outer surface of the body section 104 and the receive section 102 and thus a zero electric field is generated at the outer surfaces, which form a split plane when the receive section 102 and the body section 104 are joined together. Accordingly, the split plane exists on the zero current regions of the waveguides forming the receiver unit.

According to aspects of the subject technology, the receiver unit includes two branches that are coupled to core waveguide 110. The two branches include waveguide reject filters 412A or 412B, respectively. Waveguide reject filters 412A and 412B may have dimensions that are determined based on a frequency of the transmitted signals, and may act as transmit reject filters. Thus, waveguide reject filters 412A and 412B may perform a filtering, e.g., high pass filtering, to suppress the transmitter signals and further prevent the transmitter signals from reaching output ports 136 or 138 of the receiver unit.

The receiver unit includes an integrated branch line coupler that includes couplers 414A, 414B, and 414C that inwardly couples the two branches. The integrated branch line coupler also includes waveguide reject filters 412A and 412B that are described above. A number, size, and location of the couplers 414A, 414B, and 414C may be selected to transform left hand circular polarization as well as right hand circular polarization signals at core waveguide 110 to linearly polarized signals at output ports 136 and 138 of the two branches. In some examples, a distance between couplers 414A, 414B, and 414C, depends on diameter of core waveguide 110. In some examples, couplers 414A, 414B, and 414C are e-plane couplers.

In some embodiments, the waveguide reject filters 412A and 412B have an inner face and an outer face. In some examples, the integrated branch line coupler comprises couplers 414A, 414B, and 414C that are coupled between the inner face of the waveguide reject filters 412A or 412B.

The integrated branch line coupler may divide power and generate phase shift to create linearly polarized signals from circularly polarized signals. In some embodiments, couplers 414A, 414B, and 414C of the integrated branch line coupler generate a linearly polarized signal at a first frequency from a circularly polarized signal at the first frequency. In some embodiments, the integrated branch line coupler provides, splitting a power by 3 dB, causing 90 degrees phase shift to generate a linear polarization from a circular polarization mode, and isolating a signal to get to the other port.

The receiver unit also includes transformers 406A, 406B, 406C, and 406D on the two branches. The transformers have dimensions that are determined based on a frequency of the received signals from the core waveguide and to minimize an insertion loss of the receiver unit at output ports 136 and 138. In some embodiments, the one or more transformers of each branch are quarter wave transformers that are configured to provide a change of wavelength for matching. By using transformers 406A, 406B, 406C, and 406D, to change wavelength, the two branches may match to a receiver circuit that can be coupled to output ports 136 and 138.

According to aspects of the subject technology, the receiver unit may receive a right hand circularly polarized signal at a first frequency from core waveguide 110 and generate a linearly polarized signal at the first frequency at output port 136. The receiver unit may receive a left hand circularly polarized signal at a first frequency from core waveguide 110 and generate a linearly polarized signal at the first frequency at output port 138. In some implementations the two branches may have a 45-degree turn, e.g., bend, at an end that attaches to core waveguide 110. The 45-degree turn may allow integrated branch line coupler to stay close to core waveguide 110, reducing a size and mass of the receiver unit and creating a compact receiver unit. In some examples, placing integrated branch line coupler close to core waveguide 110 may allow more effective impedance matching between core waveguide 110 and the receiver unit.

Figure 5:
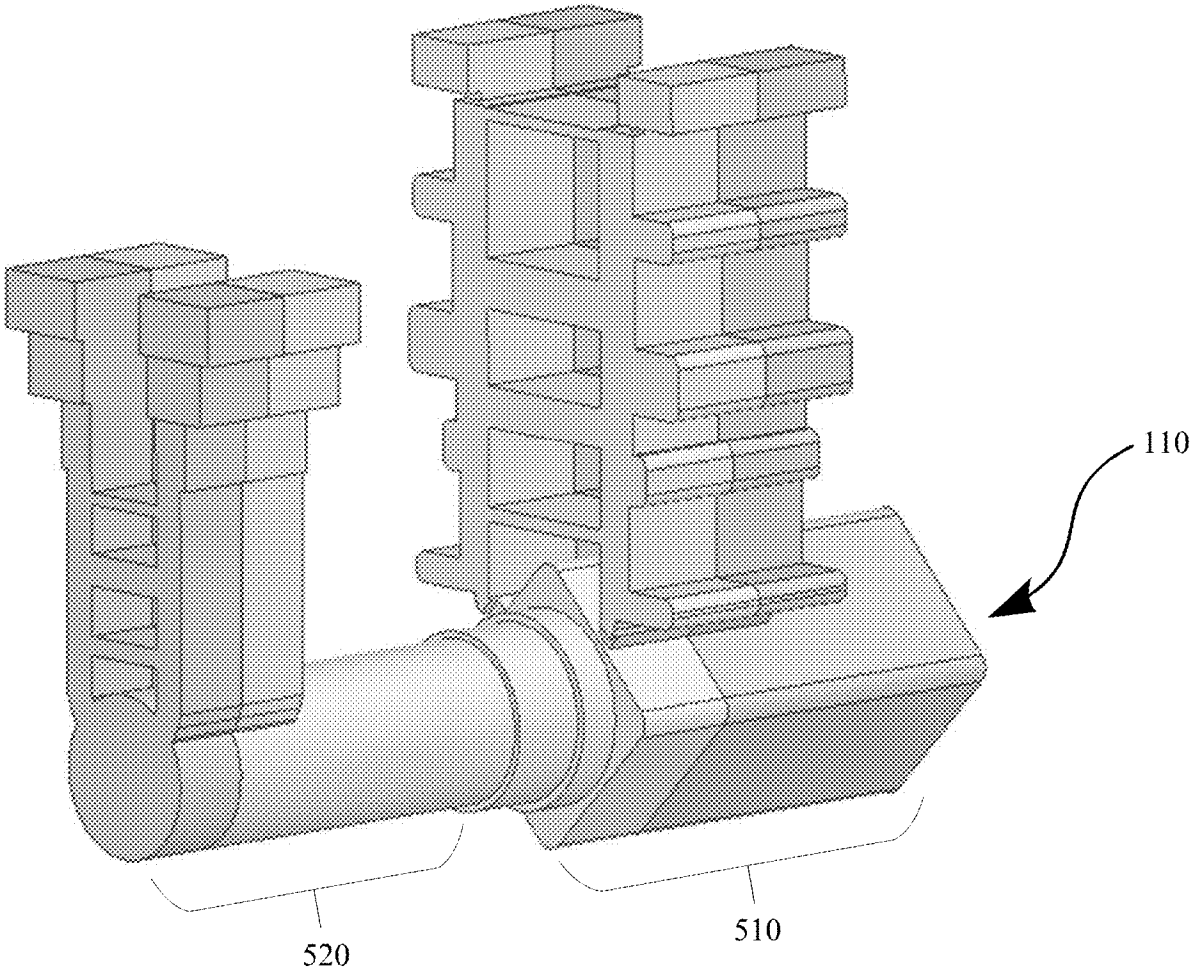
FIG. 5 is a diagram illustrating an air cavity view of a feed network according to aspects of the subject technology.

FIG. 5 is a diagram illustrating an air cavity view of a feed network according to aspects of the subject technology. As depicted, core waveguide 110 includes a first section 510 coupled to a transmitter unit and a second section 520 coupled to a receiver unit. The first section 510 of the core waveguide is a square waveguide while the second section 520 of the core waveguide is a circular waveguide. As illustrated, the transition from the square waveguide to the circular waveguide is abrupt with a couple of steps to get down to the dimensions of the second section 520 of the core waveguide. Accordingly, the first section 510 has larger dimensions than the second section 520, which results in the second section 520 having a higher cutoff frequency for propagation modes. As such, the dimensions of the second section 520 of the core waveguide are selected so that the second section 520 acts as a reject filter for the transmission frequencies. The abrupt transition from the square waveguide to the circular waveguide also simplifies the manufacturing process.

Figure 6:
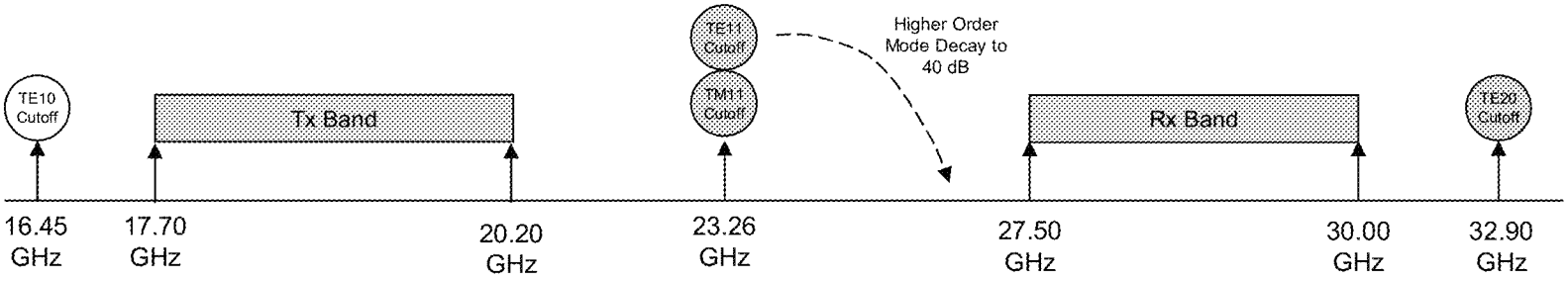
FIG. 6 is a diagram illustrating waveguide mode cutoffs according to aspects of the subject technology.
Figure 7:
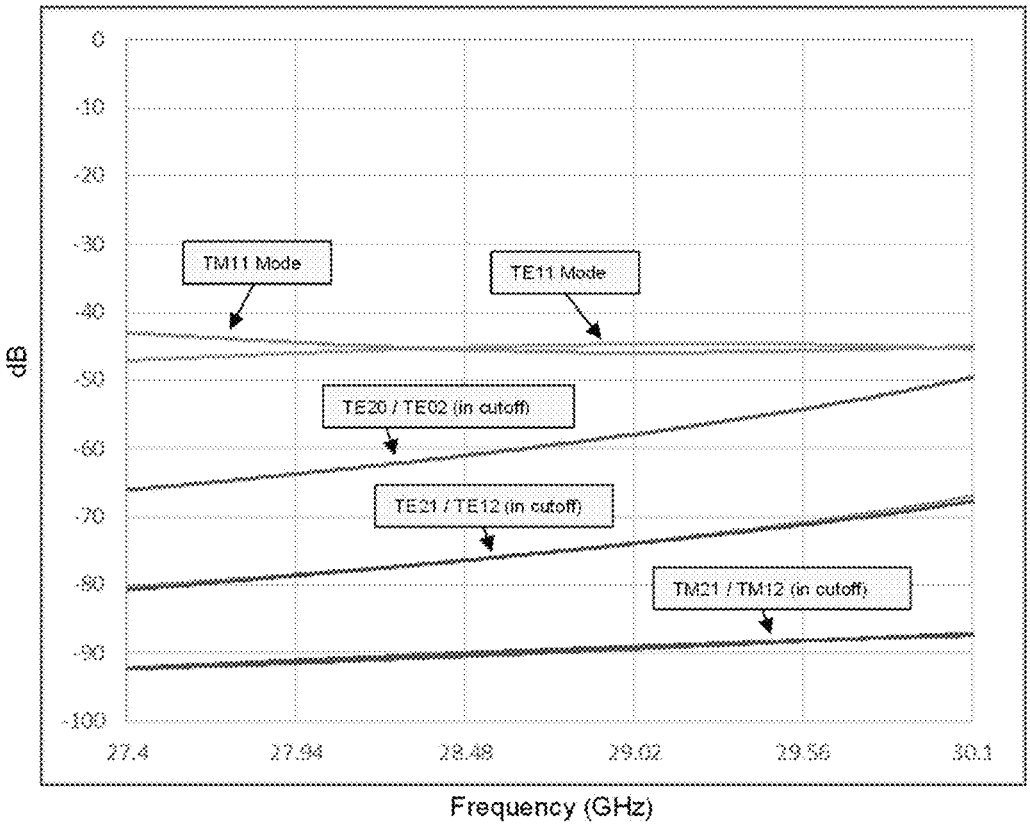
FIG. 7 is a graph illustrating the suppression of higher order modes according to aspects of the subject technology.

According to aspects of the subject technology, the first section 510 is configured as a square waveguide in order to take advantage of the degenerate TE11 and TM11 modes which decay rather than the two instances of the TE21 mode which exists in a circular waveguide. The dimensions of the waveguide sections are selected to place the cutoff frequency for the TE11 and TM11 modes between the receive band and the transmit band with enough space for the degenerate modes to decay before the lowest receive frequency. In addition, the dimensions are selected such that the TE20 mode cutoff frequency is above the highest receive frequency to allow for wider bandwidth. FIG. 6 is a diagram illustrating the mode cutoffs according to aspects of the subject technology. The mode cutoffs include the TE10 cutoff, the TE11 cutoff, the TM11 cutoff, and the TE20 cutoff. Also illustrated are a transmission (Tx) broad band of 17.7 GHz to 20.2 GHz and a receive (Rx) band of 27.5 GHz to 30.0 GHz. FIG. 7 is a graph illustrating the suppression of the higher order modes (TM11, TE11, TE20/TE02, TE21/TE12, TM21/TM12) over a receive frequency band of 27.5 GHz to 30.0 GHz. As illustrated in the graph of FIG. 7, the suppression of the higher order modes are all below 40 dB and are non-spurious.

Figure 8:
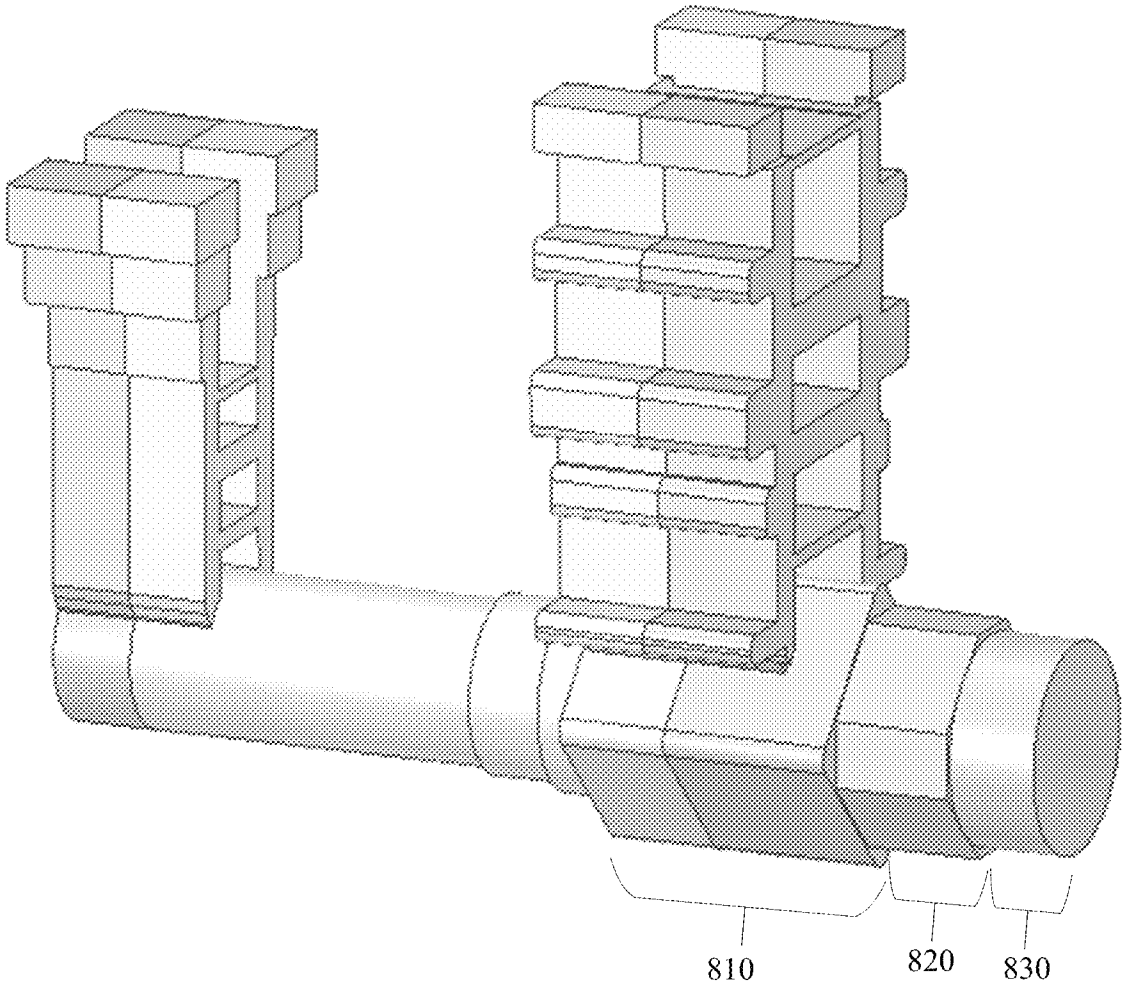
FIG. 8 is a diagram illustrating an air cavity view of a feed network according to aspects of the subject technology.

FIG. 8 is a diagram illustrating an air cavity view of a feed network according to aspects of the subject technology. Similar to the view depicted in FIG. 5, the feed network depicted in FIG. 8 includes section 810 of the core waveguide that is a square waveguide. As many apertures used in satellite communications are circular apertures, the feed network in FIG. 8 includes a transformer section 820 to transition from the square section 810 to a circular section 830 of the core waveguide.

FIG. 9 is a chart presenting performance numbers for a transmission (Tx) broad band of 17.7 GHz to 20.2 GHz, a transmission (Tx) narrow band of 17.8 GHz to 19.3 GHz, and a receive (Rx) band of 27.5 GHz to 30.0 GHz according to aspects of the technology described above. The performance numbers include frequency (Freq) (GHz), axial ratio (dB), return loss (dB), port to port isolation (Port to Port) (dB), passive intermodulation (PIM) products falling in receive (Rx) band, and higher order mode suppression (dB).

According to aspects of the subject technology, a feed network is provided that includes a transmit section, a body section coupled to the transmit section, and a receive section coupled to the body section. The transmit section and the body section form a transmitter unit coupled to a first section of a core waveguide, wherein the first section of the core waveguide is a square waveguide. The body section and the receive section form a receiver unit coupled to a second section of the core waveguide, wherein the second section of the core waveguide is a circular waveguide.

Dimensions of the square waveguide may be selected to position cutoff frequencies for a TE11 mode and a TM11 mode between a receive frequency band and a transmit frequency band. The dimensions of the square waveguide may be selected to position a cutoff frequency for a TE20 mode above the receive frequency band and the transmit frequency band. The receive frequency band may be 27.5 GHz to 30.0 GHz and the transmit frequency band may be 17.7 GHz to 20.2 GHz.

The transmitter unit may include a first branch having a first input port, a second branch having a second input port, and a first integrated branch line coupler coupling the first branch and the second branch. The transmitter unit may be configured to receive a linearly polarized signal at one of the first input port or the second input port and to generate a circularly polarized signal in the core waveguide.

The first integrated branch line coupler may include a first waveguide reject filter in the first branch comprising a first end and a second end and an outer face and an inner face, wherein the first end of the first waveguide reject filter is coupled to the first input port, and a second waveguide reject filter in the second branch comprising a first end and a second end and an outer face and an inner face, wherein the first end of the second waveguide reject filter is coupled to the second input port. The first integrated branch line coupler may further include a first group of one or more couplers coupled between the inner face of the first waveguide reject filter and the inner face of the second waveguide reject filter, a first group of one or more single-sided stubs protruding outwardly from the outer face of the first waveguide reject filter, and a second group of one or more single-sided stubs protruding outwardly from the outer face of the second waveguide reject filter. The first section of the core waveguide is coupled to the first branch via the second end of the first waveguide reject filter and to the second branch via the second end of the second waveguide reject filter.

The first group of one or more couplers of the transmitter unit may be configured to generate a 90 degree phase shift when transferring a linearly polarized signal between the first branch and the second branch. The transmitter unit may be configured to receive an input signal at a first frequency at the first input port of the first branch and to generate a right-hand circularly polarized signal at the first frequency in the core waveguide. The transmitter unit may be configured to receive an input signal at a first frequency at the second input port of the second branch and to generate a left-hand circularly polarized signal at the first frequency in the core waveguide.

The first group of one or more single-sided stubs may correspond to a first group of one or more cascaded filter sections in the first waveguide reject filter, and wherein the second group of one or more single-sided stubs correspond to a second group of cascaded filter sections in the second waveguide reject filter. The first and second waveguide reject filters of the transmitter unit may be low pass filters configured to transmit a received input signal at a first frequency from the first or second input port and to reject a second signal received from the core waveguide at a second frequency greater than the first frequency.

The feed network may further include a first group of one or more transformers coupled between the first input port of the first branch and the first end of the first waveguide reject filter, and a second group of one or more transformers coupled between the second input port of the second branch and the first end of the second waveguide reject filter, wherein the first and second groups of one or more transformers are quarter-wave transformers. The feed network may further comprise a first evanescent waveguide coupled between the second end of the first waveguide reject filter and the core waveguide, and a second evanescent waveguide coupled between the second end of the second waveguide reject filter and the core waveguide.

The receiver unit may include a third branch having a first output port, a fourth branch having a second output port, and a second integrated branch line coupler coupling the third branch and the fourth branch of the receiver unit. The receiver unit may be configured to receive a circularly polarized signal from the core waveguide and generate a linearly polarized signal at one of the first output port or the second output port. The second integrated branch line coupler may include a third waveguide reject filter in the third branch comprising a first end and a second end and an outer face and an inner face, a fourth waveguide reject filter in the fourth branch comprising a first end and a second end and an outer face and an inner face, and a second group of one or more couplers coupled between the inner face of the third waveguide reject filter and the inner face of the fourth waveguide reject filter. The receiver unit may further include a third group of one or more transformers coupled between the second end of the third waveguide reject filter and the first output port, and a fourth group of one or more transformers coupled between the second end of the fourth waveguide reject filter and the second output port, wherein the third and fourth groups of one or more transformers are quarter-wave transformers.

According to aspects of the subject technology, a feed network is provided that includes a transmitter unit that includes a first branch having a first input port, a second branch having a second input port, and a first integrated branch line coupler coupling the first branch and the second branch. The feed network further includes a first section of a core waveguide, wherein the first section of the core waveguide is a square waveguide having dimensions selected to position cutoff frequencies for a TE11 mode and a TM11 mode between a receive frequency band and a transmit frequency band, and wherein the transmitter unit is configured to receive a linearly polarized signal at one of the first input port or the second input port and to generate a circularly polarized signal in the core waveguide.

The first integrated branch line coupler may include a first waveguide reject filter in the first branch comprising a first end and a second end and an outer face and an inner face, wherein the first end of the first waveguide reject filter is coupled to the first input port, a second waveguide reject filter in the second branch comprising a first end and a second end and an outer face and an inner face, wherein the first end of the second waveguide reject filter is coupled to the second input port, a first group of one or more couplers coupled between the inner face of the first waveguide reject filter and the inner face of the second waveguide reject filter, a first group of one or more single-sided stubs protruding outwardly from the outer face of the first waveguide reject filter, and a second group of one or more single-sided stubs protruding outwardly from the outer face of the second waveguide reject filter. The first section of the core waveguide may be coupled to the first branch via the second end of the first waveguide reject filter and to the second branch via the second end of the second waveguide reject filter.

The feed network may further include a receiver unit that includes a third branch having a first output port, a fourth branch having a second output port, and a second integrated branch line coupler coupling the third branch and the fourth branch of the receiver unit. The feed network may further include a second section of the core waveguide, wherein the second section of the core waveguide is a circular waveguide, and wherein the receiver unit is configured to receive a circularly polarized signal from the core waveguide and generate a linearly polarized signal at one of the first output port or the second output port.

The second integrated branch line coupler may include a third waveguide reject filter in the third branch comprising a first end and a second end and an outer face and an inner face, a fourth waveguide reject filter in the fourth branch comprising a first end and a second end and an outer face and an inner face, and a second group of one or more couplers coupled between the inner face of the third waveguide reject filter and the inner face of the fourth waveguide reject filter.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as "an aspect", "the aspect", "another aspect", "some aspects", "one or more aspects", "an implementation", "the implementation", "another implementation", "some implementations", "one or more implementations", "an embodiment", "the embodiment", "another embodiment", "some implementations", "one or more implementations", "a configuration", "the configuration", "another configuration", "some configurations", "one or more configurations", "the subject technology", "the disclosure", "the present disclosure", other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration". Any embodiment described herein as "exemplary" or as an "example" is not necessarily to be construed as preferred or advantageous over other implementations. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more". Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The invention claimed is:

1. A feed network, comprising:

a transmit section;

a body section coupled to the transmit section; and a receive section coupled to the body section, wherein the transmit section and the body section form a transmitter unit coupled to a first section of a core waveguide, wherein the first section of the core waveguide is a square waveguide, and wherein dimensions of the square waveguide are selected to position cutoff frequencies for a TE11 mode and a TM11 mode between a receive frequency band and a transmit frequency band.

2. The feed network of claim 1, wherein the dimensions of the square waveguide are selected to position a cutoff frequency for a TE20 mode above the receive frequency band and the transmit frequency band.

3. The feed network of claim 2, wherein the receive frequency band is 27.5 GHz to 30.0 GHz and the transmit frequency band is 17.7 GHz to 20.2 GHz.

4. The feed network of claim 1, wherein the transmitter unit comprises:

a first branch having a first input port;

a second branch having a second input port; and a first integrated branch line coupler coupling the first branch and the second branch, wherein the transmitter unit is configured to receive a linearly polarized signal at one of the first input port or the second input port and to generate a circularly polarized signal in the core waveguide.

5. The feed network of claim 4, wherein the first integrated branch line coupler comprises:

a first waveguide reject filter in the first branch comprising a first end and a second end and an outer face and an inner face, wherein the first end of the first waveguide reject filter is coupled to the first input port;

a second waveguide reject filter in the second branch comprising a first end and a second end and an outer face and an inner face, wherein the first end of the second waveguide reject filter is coupled to the second input port;

a first group of one or more couplers coupled between the inner face of the first waveguide reject filter and the inner face of the second waveguide reject filter;

a first group of one or more single-sided stubs protruding outwardly from the outer face of the first waveguide reject filter; and a second group of one or more single-sided stubs protruding outwardly from the outer face of the second waveguide reject filter, wherein the first section of the core waveguide is coupled to the first branch via the second end of the first waveguide reject filter and to the second branch via the second end of the second waveguide reject filter.

6. The feed network of claim 5, further comprising:

a first evanescent waveguide coupled between the second end of the first waveguide reject filter and the core waveguide; and a second evanescent waveguide coupled between the second end of the second waveguide reject filter and the core waveguide.

7. The feed network of claim 5, wherein the first group of one or more couplers of the transmitter unit are configured to generate a 90 degree phase shift when transferring the linearly polarized signal between the first branch and the second branch.

8. The feed network of claim 5, wherein the transmitter unit is configured to receive an input signal at a first frequency at the first input port of the first branch and to generate a right-hand circularly polarized signal at the first frequency in the core waveguide.

9. The feed network of claim 5, wherein the transmitter unit is configured to receive an input signal at a first frequency at the second input port of the second branch and to generate a left-hand circularly polarized signal at the first frequency in the core waveguide.

10. The feed network of claim 5, wherein the first group of one or more single-sided stubs correspond to a first group of one or more cascaded filter sections in the first waveguide reject filter, and wherein the second group of one or more single-sided stubs correspond to a second group of cascaded filter sections in the second waveguide reject filter.

11. The feed network of claim 5, wherein the first and second waveguide reject filters of the transmitter unit are low pass filters configured to transmit a received input signal at a first frequency from the first or second input port and to reject a second signal received from the core waveguide at a second frequency greater than the first frequency.

12. The feed network of claim 5, further comprising:

a first group of one or more transformers coupled between the first input port of the first branch and the first end of the first waveguide reject filter; and a second group of one or more transformers coupled between the second input port of the second branch and the first end of the second waveguide reject filter, wherein the first and second groups of one or more transformers are quarter-wave transformers.

13. A feed network, comprising:

a transmit section;

a body section coupled to the transmit section; and a receive section coupled to the body section, wherein the transmit section and the body section form a transmitter unit coupled to a first section of a core waveguide, wherein the body section and the receive section form a receiver unit coupled to a second section of the core waveguide, and wherein the receiver unit comprises:

a third branch having a first output port;

a fourth branch having a second output port; and a second integrated branch line coupler coupling the third branch and the fourth branch of the receiver unit, wherein the receiver unit is configured to receive a circularly polarized signal from the core waveguide and generate a linearly polarized signal at one of the first output port or the second output port.

14. The feed network of claim 13, wherein the second integrated branch line coupler comprises:

a third waveguide reject filter in the third branch comprising a first end and a second end and an outer face and an inner face;

a fourth waveguide reject filter in the fourth branch comprising a first end and a second end and an outer face and an inner face; and a second group of one or more couplers coupled between the inner face of the third waveguide reject filter and the inner face of the fourth waveguide reject filter.

15. The feed network of claim 14, wherein the receiver unit further comprises:

a third group of one or more transformers coupled between the second end of the third waveguide reject filter and the first output port; and a fourth group of one or more transformers coupled between the second end of the fourth waveguide reject filter and the second output port, wherein the third and fourth groups of one or more transformers are quarter-wave transformers.

16. A feed network, comprising:

a transmitter unit comprising:

a first branch having a first input port;

a second branch having a second input port; and a first integrated branch line coupler coupling the first branch and the second branch; and a first section of a core waveguide, wherein the first section of the core waveguide is a square waveguide having dimensions selected to position cut-off frequencies for a TE11 mode and a TM11 mode between a receive frequency band and a transmit frequency band, and wherein the transmitter unit is configured to receive a linearly polarized signal at one of the first input port or the second input port and to generate a circularly polarized signal in the core waveguide.

17. The feed network of claim 16, wherein the first integrated branch line coupler comprises:

a first waveguide reject filter in the first branch comprising a first end and a second end and an outer face and an inner face, wherein the first end of the first waveguide reject filter is coupled to the first input port;

a second waveguide reject filter in the second branch comprising a first end and a second end and an outer face and an inner face, wherein the first end of the second waveguide reject filter is coupled to the second input port;

a first group of one or more couplers coupled between the inner face of the first waveguide reject filter and the inner face of the second waveguide reject filter;

a first group of one or more single-sided stubs protruding outwardly from the outer face of the first waveguide reject filter; and a second group of one or more single-sided stubs protruding outwardly from the outer face of the second waveguide reject filter, wherein the first section of the core waveguide is coupled to the first branch via the second end of the first waveguide reject filter and to the second branch via the second end of the second waveguide reject filter.

18. The feed network of claim 17, further comprising:

a receiver unit comprising:

a third branch having a first output port;

a fourth branch having a second output port; and a second integrated branch line coupler coupling the third branch and the fourth branch of the receiver unit; and a second section of the core waveguide, wherein the second section of the core waveguide is a circular waveguide, and wherein the receiver unit is configured to receive a circularly polarized signal from the core waveguide and generate a linearly polarized signal at one of the first output port or the second output port.

19. The feed network of claim 18, wherein the second integrated branch line coupler comprises:

a third waveguide reject filter in the third branch comprising a first end and a second end and an outer face and an inner face;

a fourth waveguide reject filter in the fourth branch comprising a first end and a second end and an outer face and an inner face; and a second group of one or more couplers coupled between the inner face of the third waveguide reject filter and the inner face of the fourth waveguide reject filter.

* * * * *